US006553920B1

(12) United States Patent
Galtieri

(10) Patent No.: US 6,553,920 B1
(45) Date of Patent: Apr. 29, 2003

(54) TABLE EXTENSIBLE BY TURNING OVER ITS SIDE BOARDS

(76) Inventor: Giuseppe Galtieri, Via Ducezio, 36, Park Palace, Messina (IT), I-98100

( * ) Notice: Subject to any disclaimer, the term of this patent is extended or adjusted under 35 U.S.C. 154(b) by 0 days.

(21) Appl. No.: 09/890,106

(22) PCT Filed: Nov. 24, 2000

(86) PCT No.: PCT/IT00/00476

§ 371 (c)(1),
(2), (4) Date: Jul. 26, 2001

(87) PCT Pub. No.: WO01/37703

PCT Pub. Date: May 31, 2001

(30) Foreign Application Priority Data

Nov. 26, 1999 (IT) ..... RM99A0725

(51) Int. Cl.[7] ..... A47B 1/00
(52) U.S. Cl. ..... 108/63; 108/70; 108/66
(58) Field of Search ..... 108/66, 84, 69, 108/63, 62

(56) References Cited

U.S. PATENT DOCUMENTS 1,940,117 A * 12/1933 Capros ..... 108/157.18

FOREIGN PATENT DOCUMENTS

| | | | | |
|---|---|---|---|---|
| DE | 201151 C | * | 8/1908 | |
| DE | 029708291 U | * | 7/1997 | |
| FR | 2464039 | * | 4/1981 | ..... 108/63 |
| GB | 15482 | * | of 1894 | ..... 108/63 |
| GB | 5608 | * | of 1904 | ..... 108/63 |
| JP | 10-179259 A | * | 7/1998 | |

* cited by examiner

*Primary Examiner*—Lanna Mai
*Assistant Examiner*—Jerry A. Anderson
(74) *Attorney, Agent, or Firm*—Browdy and Neimark, P.L.L.C.

(57) ABSTRACT

A table extensible by turning over its side boards, constituted by a horizontal plane, having peripheral parts with upper side boards and lower side boards shaped as circle segments and a central part enclosed thereby. The central part is able to rotate on a base and is vertically movable relative thereto by means of cam profiles, which are fastened to the central part between the top surface of the lower side boards and of the upper side boards, which are fastened to the central part. The lower side boards are joined to a frame, bearing down on said base whilst the upper side boards are hinged to the upper side boards to be turned over outwardly.

10 Claims, 4 Drawing Sheets

TABLE EXTENSIBLE BY TURNING OVER ITS SIDE BOARDS

REFERENCE TO RELATED APPLICATIONS

The present application is the national stage under 35 U.S.C. 371 of international application PCT/IT00/00476, filed Nov. 24, 2000, which designated the United States, and which international application was published under PCT Article 21(2) in the English language.

TECHNICAL FIELD

The present invention relates to a table which can be extended by turning over its side boards. This table can be used in public locales, or wherever there is a need to match the number of places at the tables to the number of customers.

BACKGROUND ART

Currently, to increase the number of persons sitting at the same table, two or more tables are moved close together. Such tables are square or rectangular, since round tables cannot be set side by side, due to the lack of continuity of the horizontal planes.

Square or rectangular tables which in public venues are usually for two or four persons leads to the formation of elongated table sets where the people sharing the meal can only relate with those sitting next to them or at the opposite side of the table. Moreover, when tables are simply set side by side, table furnishings are generally not very elegant, giving a sense of patched up precariousness.

Another problem encountered by public locale managers is represented by the need to make some halls multifunctional, e.g. by transforming them into dining halls and dancing halls or other uses. In this case, the hall would have to be momentarily emptied by placing the tables, appropriately disassembled, in small storage spaces. This is currently done only with common foldable tables, whereas it would be useful for extensible tables to be constructed as modular tables, to be disassembled or collapsed when necessary.

The same needs, albeit on a reduced scale, are encountered in modern homes, where furnishing solutions that allow to optimise space are sought and appreciated.

DISCLOSURE OF THE INVENTION

The present invention aims to overcome the aforementioned drawbacks.

In particular, a purpose of the present invention is to provide a table which can be transformed rapidly, in a convenient, effective and elegant manner, making more or less ample the surface of its horizontal plane.

The term "horizontal plane" indicates the set of parts constituting the upper surface of the table, whilst the term "base" indicates any structure sustaining said horizontal plane, for instance a column or a base conventionally provided with legs and fixed feet or equipped with wheels or other means for moving. It is known that this upper surface of the table must be uniformly plane, both when in a non-extended position and when in an extended position.

Another aim of the invention is to provide a table having a horizontal plane with an extensible surface which can be easily disassembled for storage in a minimal space, and reassembled when necessary.

The present invention provides a table which can be extended by tuning over, its side boards, constituted by a horizontal plane, having relatively movable pans, and by a base for said horizontal plane. Said parts of the horizontal plane comprise multiple peripheral parts, formed by pairs of equal and superposed upper and lower side boards, having straight sides defining a geometric figure. A central part, enclosed by said peripheral parts and having a shape complementary to the overall shape of the peripheral parts relative to the geometric shape defined thereby;

said central part of the horizontal plane by means of a vertical shaft beings mounted so as to be able to rotate on said base and to move vertically by means of cam profiles provided in the bottom of said central part, the peripheral parts of the horizontal plane being fastened to the central swivelling part according to an arc of rotation corresponding to its vertical motion on said cam profiles;

said lower side boards being joined to an underlying frame, bearing down on said base, and constituting, together with the upper side boards, the edge of the table in its non-extended state;

said upper side boards being hinged to said lower side boards according to an axis passing along the respective straight outer sides and, when turned over outwardly about said axis by a flat angle relative to the lower side boards until bearing down on said base, constituting the edge of the table in its extended state.

DESCRIPTION OF THE DRAWINGS

Further features and advantages of the invention shall become more readily apparent from the detailed description that follows, made with reference to the accompanying drawings, which represent embodiments provided purely by way of non limiting examples in which.

DESCRIPTION OF THE ILLUSTRATIVE EMBODIMENT

In accordance with the figures, the extensible table according to the invention is constituted by a horizontal plane, globally indicated with the reference number 1 and having various relatively movable parts, and by a base 2 for said horizontal plane.

Figure 1:
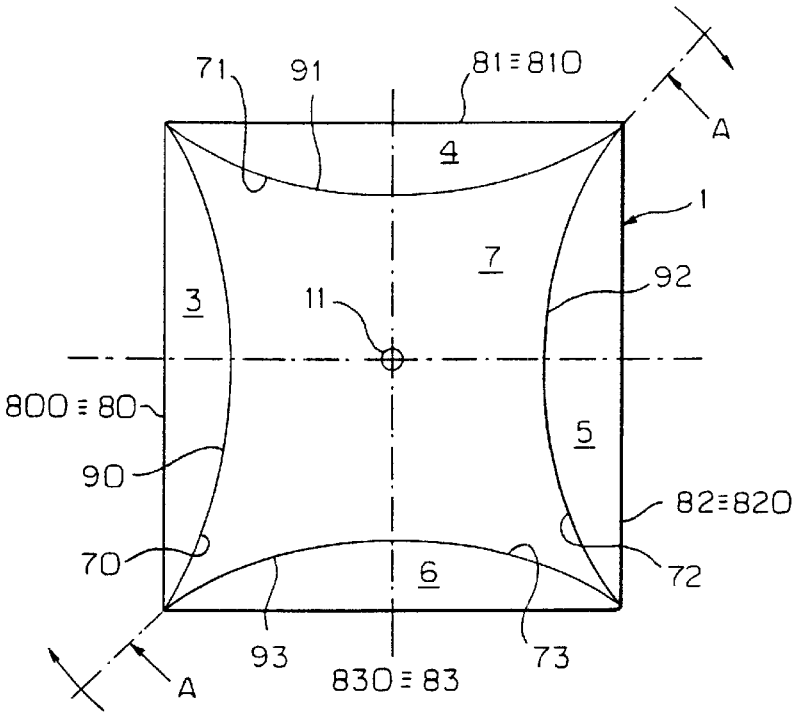
FIG. 1 is a top plan view of a table according to the present invention in a non-extended state of its horizontal plane.

FIG. 1 shows a top view of an embodiment of the table of the invention in a non-extended state. The horizontal plane 1, which embodies the upper or bearing surface of the table, is square and it is constituted by multiple peripheral parts 3, 4, 5, 6 and by a central part 7 enclosed thereby. Each of the peripheral parts 3, 4, 5 and 6 has the shape of a circular sediment having a straight outer side 80, 81, 82 and respectively. 83 and a curved inner side 90, 91, 92, and respectively 93 substantially coincident with the side 70, 71, 72 and, respectively 73 of the central part 7. It should be stated immediately that the surface of the horizontal plane 1 can, unlike the one shown herein, be that of another regular or irregular polygon with straight sides, whereas the part 7 can have straight instead of concave sides. Moreover, the vertices of the central part 7 can be non coincident with the vertices of the polygon of the upper surface of the horizontal plane and hence generally recessed relative to the outer perimeter thereof. The necessary condition is that the straight sides 80, 81, 82 and 83 of the upper surface of the horizontal plane 1 define consecutively a geometric figure, and the central part, enclosed by said sides, has a complementary shape to the overall shape of the peripheral parts 3, 4, 5, 6 relative to the geometric figure defined thereby.

Figure 5:
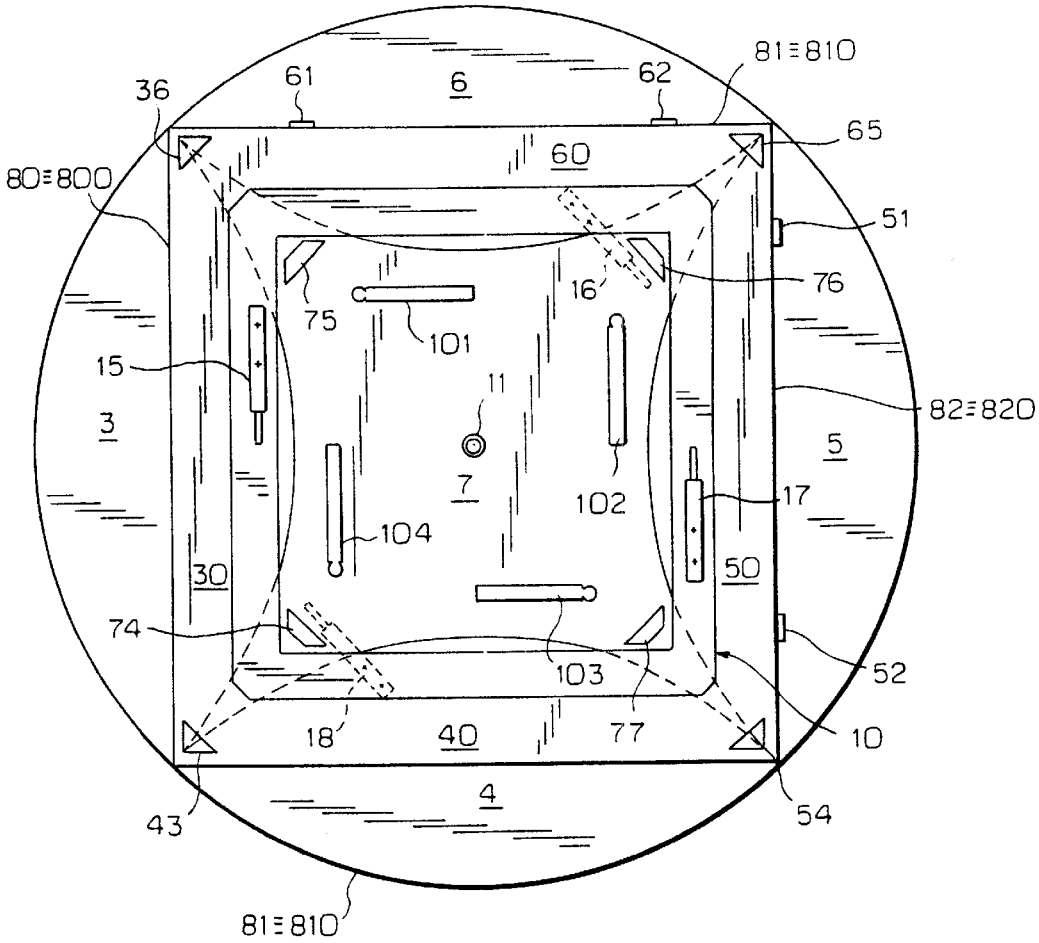
FIG. 5 is a bottom plan view, in slightly enlarged scale, of the horizontal plane of the table of FIG. 1, in an extended state.
Figure 7:
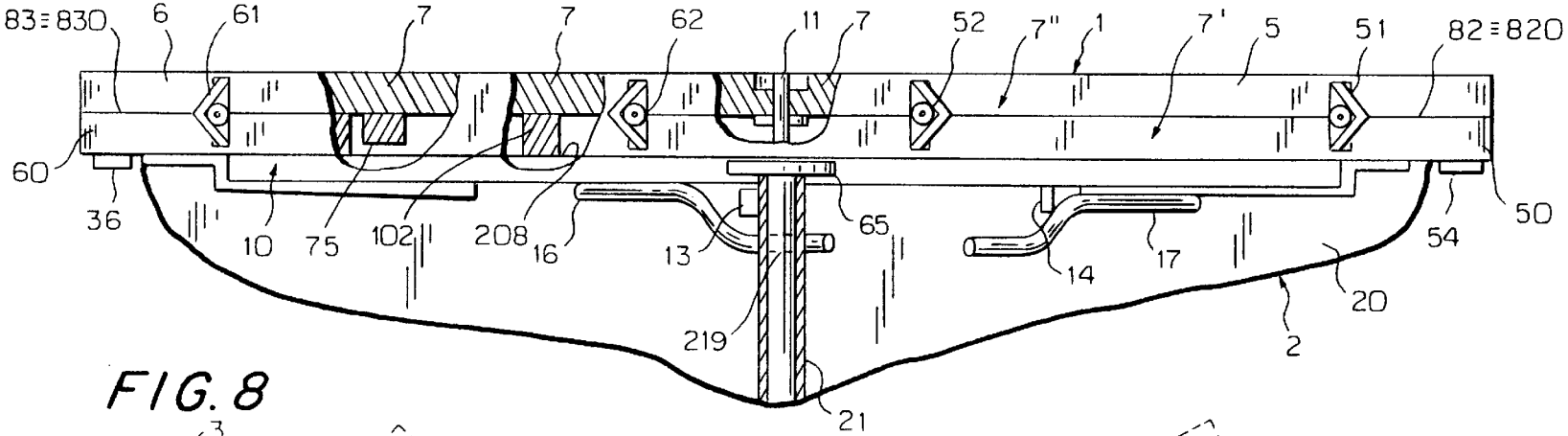
FIG. 7 is a partial lateral view of the table according to the invention, partially sectioned along the line A—A of FIG. 1.

As shown in FIG. 7, which is a partial lateral view of the table along section line A—A of FIG. 1, the peripheral parts 5 and 6 constitute upper side boards of the table in their non extended state as shown in FIG. 1, together with underlying identical lower side boards 50 and 60. As shown in FIG. 5, the upper side boards 3, 4, 5 and 6 are joined to the lower side boards by means of hinges, for instance laminar hinges 51, 52 and 61, 62 between the side boards 5, 50 and 6, 60. The hinges define axes of rotation substantially coinciding with the sides 80, 81, 82, 83 of the upper side boards 3, 4, 5 and 6 and with the sides 800, 810, 820, 830 of the lower side boards 30, 40, 50 and 60.

Figure 2:
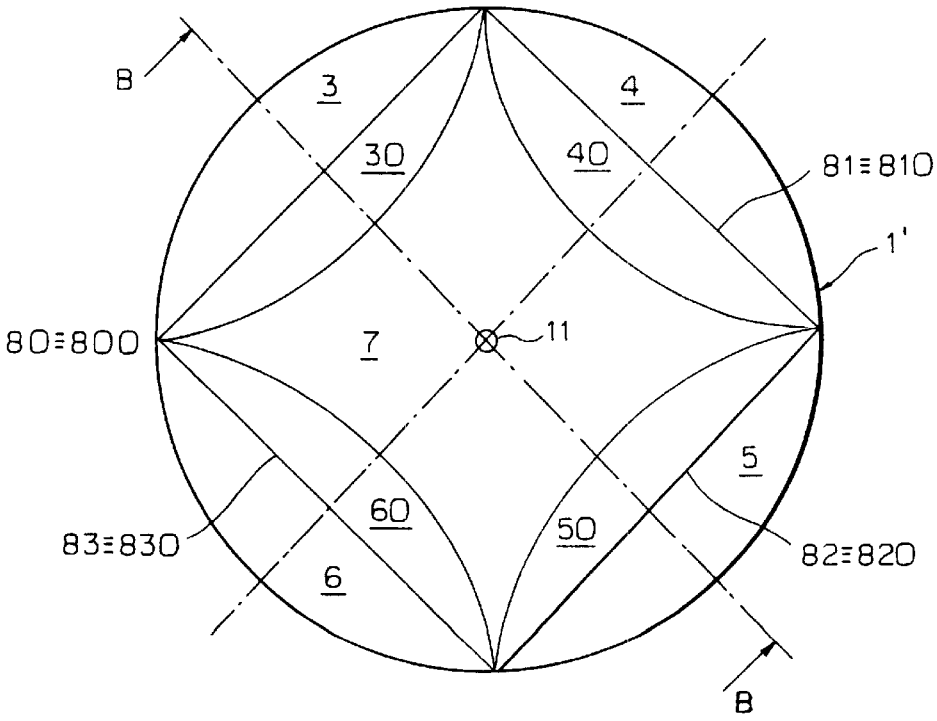
FIG. 2 is a top plan view of the horizontal plane of the table of FIG. 1 in its extended state.
Figure 8:
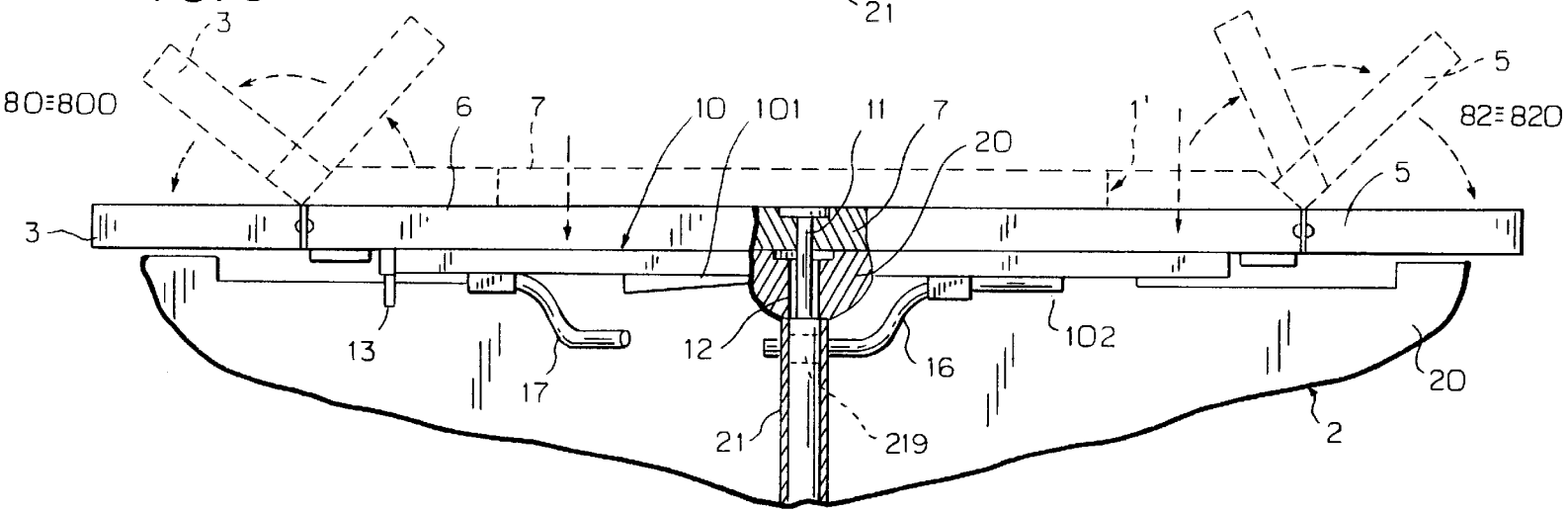
FIG. 8 is a partial lateral view of the table according to the invention partially sectioned along the line B—B of FIG. 2.

Therefore, rotating the upper side boards 3, 4, 5, 6 outwardly by roughly 180° around the axes of the hinges a which coincide with the sides of the upper and lower side boards results in the horizontal square planes of FIG. 1 being extended into the horizontal round plane 1' shown in, FIGS. 2 and 8.

As shown in FIG. 5, which is a bottom plan view of the horizontal plane, the lower side boards 30, 40, 50 and 60 are mutually joined consecutively at their ends by means of gussets 36, 65, 54, 43, but obviously other means of joining the ends can be provided. Moreover, the lower side boards are joined by a frame 10, which in the embodiment shown herein is square, but which could be different depending on the number of the lower side boards used.

As shown in FIG. 5, the central part 7 is provided with elements 74, 75, 76, 77 for locating central part 7 within the opening 7' between lower side boards 30, 40, 50, 60 and with the related frame 10.

As shown in FIG. 5, the central part 7 of the horizontal plane 1 (1' in its extended state) is provided in its lower part with cam profiles generically indicated as 101, 102, 103, 104. These profiles, generally shaped as inclined planes, are further described farther on. The central part 7 further presents a vertical shaft 11 destined to engage in a corresponding seat 12 obtained in the base 2.

Figure 3:
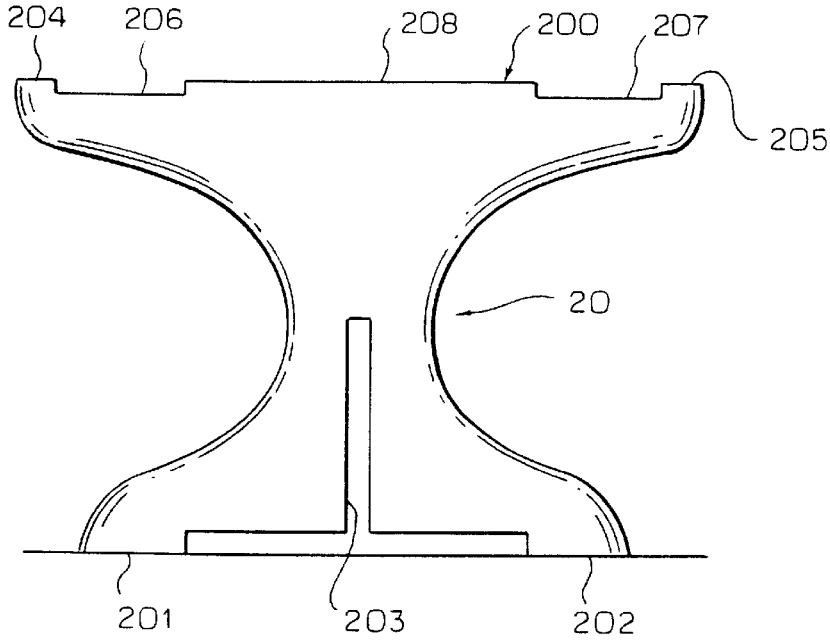
FIG. 3 is a a vertical lateral view of a first pair of legs for a base of a table according to the invention.
Figure 4:
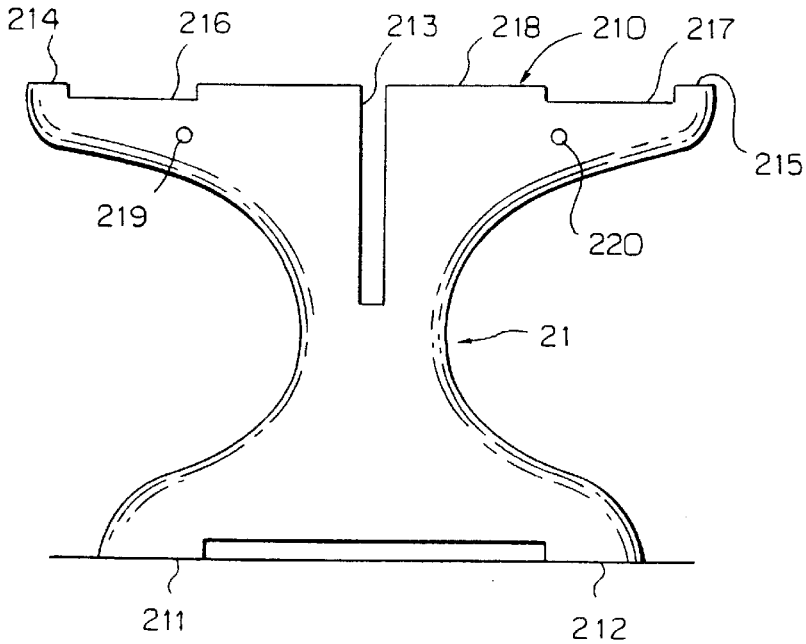
FIG. 4 is a vertical lateral view of a second pair of legs for a base of a table according to the invention.
Figure 6:
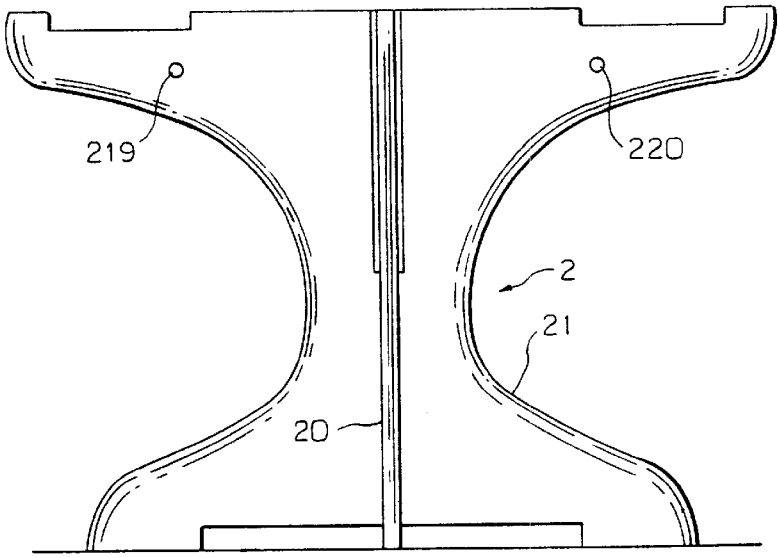
FIG. 6 is a vertical lateral view of the table base with the leg pairs of FIGS. 3 and 4.

As shown in FIGS. 3, 4, and 6, the base 2 is constituted by two pairs of legs appropriately shaped, flattened, 20, 21, joined orthogonally. In the upper part each pair of legs 20, 21 superiorly presents a profile 200, 210 for bearing the horizontal plane 1, 1', and inferiorly feet 201, 202 and 211, 212.

To form the base 2, the pair of legs 20 is joined to the pair of legs 21 in a form able to be disassembled. For this purpose the pair of legs 20 presents a lower central slot 203 extending to half of its height, whilst the pair of legs 21 presents an upper central slot 213 extending from the top down to half of its height. In this way, the leg pairs can be inserted one into the other with ease, creating a stable structure and be disassembled with the same ease to reduce the space taken up.

Obviously, the connection of the leg pairs can be enhanced by their mutual fastening, in a conventional manner.

As shown in FIG. 7, the leg pair 20 presents superiorly the central hole 12 able to receive, vertically movable, the vertical shaft 11 for the rotation of the horizontal plane on the bearing profile 200, 210.

Each leg pair has on its summit 200, 210 outer bearing portions 204, 205 and 214, 215 for the lower and upper side boards, intermediate lowered portions 206, 207 and 216, 217 for supporting the frame 10 and central portions 208, 218 for engagement with the bottom of the central part 7.

As shown in FIGS. 7 and 8, the frame 10 presents at least a pair of arresting elements in the form of vertical stop pins 13, 14 against at least one of said leg pair to limit the arc of rotation of the central part 7, as shall be explained farther on.

Moreover, the frame 10 presents two pairs of latching elements with the leg pairs 20, 21. They are constituted by horizontal pivot pins 15, 16, and 17, 18 fastened projecting inferiorly from the frame 10 and destined to be engaged by the rotation of the central part of the horizontal plane into through holes 219, 220 obtained symmetrically opposite in the leg pair 21. The horizontal pivot pins 15, 16 and 17, 18 are also limit stops so they can replace in this function the aforesaid vertical stop pins 13, 14.

The operation of the table according to the invention is as follows.

When the table is in the non-extended, square state (FIGS. 1, 7), the uppers side boards 3, 4, 5, 6 and lower side boards 30, 40, 50, 60 of the horizontal square plane 1 are superposed. The central part 7 of the horizontal plane 1, shown in FIG. 1 which is able to rotate, bears on the base 2 through an opening 7" via the uppermost part of the inclined plane shaped cam profile 102. The position of the inclined plane is defined by the check element 13 integral with the frame 10, with which is also engaged the central part 7. In the case in which the table is of the demountable type, the presence of the latching element 17, also fastened to the frame 10, is advantageous. When the latching element 17 is inserted into the hole 219, this allows a stable connection between horizontal plane 1 and base 2, which allows it to be moved as a single body.

When the table needs to be brought to the extended, round state (FIGS. 2, 8), the horizontal plane is rotated by an arc of about 45° clockwise relative to the position of FIG. 7. The upper side boards 3, 4, 5, 6 are then turned over by 180° outwardly relative to the central part 7 about axes substantially coinciding with their straight sides, in such a way as to bear down on the portions 204, 205, 214, 215 of base 2. In the aforesaid rotation the central portion 7 is displaced downwards through opening 7' thanks to the fact that the lower parts of the inclined plane profiles are the ones that interact with the portions 208, 218 of the base 2. The position of the inclined plane is defined by the check element 14 (not visible in FIG. 8) integral with the frame 10. In the case in which the table is of the demountable type, the presence of the element 16, fastened to the frame 10, in such a position as to replace as a result of the 45° clockwise rotation the horizontal pivot pin in the same hole 219, is advantageous. In this way, a stable connection is allowed between horizontal plane 1 and base 2, even in the extended state of the horizontal plane 1.

The horizontal plane 1 thereby has a planar bearing surface both in an extended state and in a non-extended state.

To summarise, in the rotary motion of roughly 45 of the central part 7, its raising or lowering relative to the upper side boards 3, 4, 5 and 6 is obtained, along with the locking and unlocking of the horizontal plane relative to the base.

It should also be observed that the table according to the invention is easily demountable by rotating its horizontal plane between the two positions described above, offset by 45°. In a position in which none of the latching elements of the frame 10 is latched with the base 2, the horizontal plane can be raised, fully or, by freeing at first the side boards from their engagement with the central part, and then lifting the central part from the base, by extracting the shaft 11 from the seat 12 thereof.

The invention thus conceived can be subject to numerous modifications and variations, without thereby departing from the scope of the inventive concept. For instance, the shape of the connecting frame can be different from the one shown, and the linear actuator can be of a different type from the one described herein. Moreover, the 45° rotation of the central part 7 and hence of the entire horizontal plane is not constraining, because it depends on the selection of the related cam profiles.

What is claimed is:

1. An extensible table comprising:

a base; and a table top;

the table top comprising:

a lower side having a plurality of first side boards each having a first straight edge and a first curved edge, each end each of the first side boards being respectively fixed to an end of an adjacent first side board to form a coplanar surface having a first opening enclosed by the curved edges;

an upper side having a plurality of second side boards each having a second straight edge and a second curved edge, the first and second straight edges and the first and second curved edges being equal to each other, the straight edges of the second side boards being respectively hinged to the straight edges of the first side boards to permit rotation from a first position wherein the second side boards overlay the first side boards to form a second opening equal to that of the first opening to a second position where the second side boards are coplanar with the first side boards; and a central part having a periphery equal to that of both the first opening and the second opening, a vertical shaft rotatably engaged in a vertical recess on the base and an inclined cam means fixed to a bottom side of the central part to permit rotating the central part in the vertical recess so that the central part is engaged on the base to be either coplanar with the second side boards in the first position or coplanar with the first side boards in the second position.

2. The extensible table according to claim 1, wherein the curved edges of the first side boards and the second side boards are an arc of a circle.

3. The extensible table according to claim 1, wherein the base has two flat pairs of legs joined together at right angles each having feet and a top bearing surface for the first side boards and the second side boards.

4. The extensible table according to claim 3, wherein said leg pairs (20, 21) are demountable and collapsible, a first (20) of said leg pairs having a lower central slot (203) extending to half a height thereof and an upper central hole (12) forming the recess of rotation of said shaft (11), a second (21) of said leg pairs having an upper central slot (213) extending from above down to half the height thereof so that the leg pairs can be inserted into each other.

5. The extensible table according to claim 4, wherein said frame (10) has at least a pair of arresting and latching elements (16, 17) fixable with at least one (21) of said leg pairs (20, 21), to limit an angle of rotation of said central part (7).

6. The extensible table according to claim 5, wherein said pair of arresting and latching elements (16, 17) is constituted by pivot pins fastened to said frame and projecting parallel therefrom engageable after the rotation of the central part with at least a through hole (219) symmetrically opposite to at least 1, in said second leg pair (21).

7. The extensible table according to claim 3, wherein said leg pairs (20, 21) are fixed together to form said base (2).

8. The extensible table according to claim 7, wherein said frame has at least a pair of arresting elements (13, 14) engageable with at least one of said leg pairs (21) to limit an angle of rotation of said central part (7).

9. The extensible table according to claim 1, wherein the first side boards are engaged by a frame which rests on the base, wherein the straight edges of the first side boards and the second side boards form an outer edge of the table in the first position.

10. The extensible table according to claim 1, wherein the curved edges of the second side boards form an outer edge of the table when extended in the second position and rest on the base.

* * * * *